US011641962B1

(12) United States Patent
Foxx

(10) Patent No.: US 11,641,962 B1
(45) Date of Patent: May 9, 2023

(54) EATING UTENSIL HAVING A HOLDER

(71) Applicant: Gerald Foxx, Chicago, IL (US)

(72) Inventor: Gerald Foxx, Chicago, IL (US)

( * ) Notice: Subject to any disclaimer, the term of this patent is extended or adjusted under 35 U.S.C. 154(b) by 0 days.

(21) Appl. No.: 17/832,352

(22) Filed: Jun. 3, 2022

(51) Int. Cl.
*A47G 21/08* (2006.01)
*A47G 21/02* (2006.01)

(52) U.S. Cl.
CPC ..... *A47G 21/08* (2013.01); *A47G 21/023* (2013.01); *A47G 2200/046* (2013.01)

(58) Field of Classification Search
CPC ..... A47G 220/046; A47G 21/08
See application file for complete search history.

(56) References Cited

U.S. PATENT DOCUMENTS 1,134,849 A * 4/1915 Hawkins ..... B26B 13/20 30/232
1,147,665 A * 7/1915 Warren ..... B26B 27/007 30/298
1,161,020 A * 11/1915 Bobbitt ..... A47J 17/02 30/123.5
1,339,282 A * 5/1920 Pelnar ..... A01D 45/026 30/232
1,775,562 A * 9/1930 Leanderg ..... A01D 46/247 30/232
2,178,019 A * 10/1939 Knuteson ..... C14B 1/02 30/169
3,224,093 A * 12/1965 Huck ..... A47G 21/08 30/324
3,942,194 A * 3/1976 Winter ..... A61F 2/588 623/65
4,325,187 A * 4/1982 Wasson ..... A47G 21/08 30/298
5,146,810 A * 9/1992 Mueller ..... B26B 13/20 30/232
5,310,345 A * 5/1994 Gershon ..... G09B 11/02 15/443
6,237,194 B1 * 5/2001 Williams ..... G09B 21/00 30/298
6,394,516 B1 * 5/2002 Zhuravsky ..... A61F 4/00 623/65
6,895,639 B1 * 5/2005 Bayton ..... A45F 5/00 30/298

(Continued)

FOREIGN PATENT DOCUMENTS

CN 105411326 A * 3/2016
DE 202012009485 U1 * 4/2013 ..... A47G 21/08

(Continued)

*Primary Examiner* — Kenneth E Peterson
(74) *Attorney, Agent, or Firm* — Quarles & Brady LLP

(57) ABSTRACT

An eating utensil includes a holder, a shaft, and a utensil head. The holder includes an elongated body having a proximal end and a distal end, and a flange extending from the distal end of the body. The shaft has a first end fixedly attached to the distal end of the body and a second end that extends from the distal end of the body such that at least a proximal portion of the shaft including the first end extends parallel to a longitudinal axis of the body, the utensil head being connected to the second end of the shaft. The holder being configured to be received within a user's hand such that a bottom surface of the flange contacts a portion of a dorsal surface located between an index finger and a thumb while the proximal end of the body is adjacent a palm.

12 Claims, 3 Drawing Sheets

(56) References Cited

U.S. PATENT DOCUMENTS

| | | | | |
|---|---|---|---|---|
| 9,205,696 | B2 * | 12/2015 | Young | B43K 23/012 |
| D839,689 | S * | 2/2019 | Ichishi | D7/642 |
| 10,709,273 | B1 * | 7/2020 | Lynn | B43L 15/00 |
| 2010/0251552 | A1 * | 10/2010 | Gazcon | B26B 1/08 30/162 |
| 2016/0081503 | A1 * | 3/2016 | Burton | E05B 19/00 294/137 |
| 2018/0092479 | A1 * | 4/2018 | Shine | A47G 21/08 |
| 2019/0216244 | A1 * | 7/2019 | Knapp | A47G 21/08 |

FOREIGN PATENT DOCUMENTS

| | | | | | |
|---|---|---|---|---|---|
| FR | 2945721 | A1 | * | 11/2010 | A47G 21/08 |
| GB | 152121 | A | * | 10/1920 | |
| KR | 20170092375 | A | * | 8/2017 | |
| KR | 20170107706 | A | * | 9/2017 | |
| KR | 20170003884 | U | * | 11/2017 | |
| KR | 20180083735 | A | * | 7/2018 | |

* cited by examiner

EATING UTENSIL HAVING A HOLDER

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present disclosure relates to an eating utensil for persons having a physical disability and more specifically to concepts related to a device configured to assist a person having diminished physical dexterity in the wrists or hands with the use of an eating utensil by securing the eating utensil to the person's hand while limiting stress on joints and nerves of the person's wrists and/or hands.

Physically disabling conditions, such as Guillain-Barré syndrome and other conditions that affect the body's nervous system, can cause difficulty in performing everyday tasks as the appendages and joints of the body are susceptible to numbness, weakness, and/or pain as a result of simple movements. Further, as most everyday tasks involve use of the arms, such as writing, typing, or even eating, diminished physical dexterity in the wrists or hands can be particularly detrimental to a person's wellbeing and independence, as the person's ability to effectively grip a writing instrument, or even a conventional eating utensil, between the fingers may have declined significantly and/or can result in unbearable discomfort after short periods of time.

Conventional solutions to assist a user having a physically disabling condition to effectively use an eating utensil have numerous shortcomings that may be undesirable for various reasons. For example, many conventional assisted eating utensils are relatively large or bulky, such that use of these devices may be readily noticeable by bystanders while the device is used in public places, which may cause a social uncomfortableness in the user. Further, some conventional assisted eating utensils are arranged such that the user must rotate their shoulder and/or wrist in order to align the utensil with their mouth while eating, which can cause more discomfort to the user during use.

Therefore, an eating utensil in which most of the eating utensil conspicuously fits within a palm of the user's hand, while, at the same time, provides adequate support to the user's hand in a more ergonomic manner may be desired.

BRIEF SUMMARY OF THE INVENTION

To this end, in at least some embodiments of the present disclosure, an eating utensil is provided that can be used to assist persons having diminished dexterity in the hands. The eating utensil can include a holder, a shaft, and a utensil head connected to the shaft. The holder can include an elongated body having a proximal end, a distal end opposite the proximal end, and a longitudinal axis extending through the proximal and the distal ends, and a flange extending from the proximal end of the body. The shaft can have a first end and a second end opposite the first end, the first end of the shaft can be fixedly attached to the distal end of the body and the second end of the shaft can extend from the distal end of the body such that at least a proximal portion of the shaft including the first end extends parallel to the longitudinal axis of the body. The utensil head can be connected to the second end of the shaft. The holder can be configured to be received within a user's hand such that a bottom surface of the flange contacts at least a portion of a dorsal surface located between an index finger and a thumb of the user's hand while the proximal end of the body is adjacent a palm of the user's hand.

In some embodiments, the holder can further include a phalange receiver arranged along the body. The phalange receiver can be configured to receive and constrain at least one phalange of the user's hand to at least one side of the body. In some embodiments, the phalange receiver includes at least a first phalange receiver and a second phalange receiver. The first phalange receiver can be arranged along the body of the holder at a first distance from the proximal end of the body, and the second phalange receiver can be arranged along the body of the holder at a second distance from the proximal end of the body, the second distance being greater than the first distance. The first phalange receiver can include a first strap and a first strap retainer, and the second phalange receiver can include a second strap and a second strap retainer. A first end of the first strap can be arranged along a first side of the body at the first distance from the proximal end of the body, and the first strap retainer can be arranged along a second side of the body at the first distance from the proximal end of the body. A first end of the second strap can be arranged along the first side of the body at the second distance from the proximal end of the body, and the second strap retainer can be arranged along the second side of the body at the second distance from the proximal end of the body. The first strap retainer can be configured to removably retain the second end of the first strap as the first strap extends along a third side of the body, the third side of the body being adjacent to both the first and the second sides of the body, and the second strap retainer can be configured to removably retain the second end of the second strap as the second strap extends along a fourth side of the body opposite the third side. In some embodiments, the first ends of the first and the second straps can be fixedly attached to the first side of the body.

In other embodiments, the first phalange receiver can be arranged on a first side of the body, and the second phalange receiver can be arranged on a second side of the body opposite the first side. The first and the second phalange receivers can be configured to be moveably fixable along the first and second sides of the body, respectively, at a plurality of distances from the proximal end of the body. The first and the second phalange receivers can further include at least one aperture extending parallel to the longitudinal axis of the body. In some embodiments, the apertures of the first and second phalange receivers can be expandable between a first diameter and a second diameter that is greater than the first diameter. Further, at least a portion of the first and second phalange receivers can be formed of an elastic material, and the first and second phalange receivers can be configured to be elastically deformable such that the apertures are expandable from the first diameter to at least the second diameter when at least one phalange of the user's hand is received within the apertures.

In some embodiments, a distal portion of the shaft can include the second end of the shaft, and the distal portion of the shaft can be arranged at an angle relative to the proximal portion of the shaft. A first angle can be in a range of about 90 degrees to about 170 degrees measured in a plane transverse to the longitudinal axis between the first side of the body and a second side of the body opposite the first side. In some embodiments, the distal portion of the shaft can be further arranged at a second angle relative to the proximal portion of shaft, the second angle being measured in a second plane that is perpendicular to the first plane.

In other aspects the present disclosure provides an eating utensil to assist persons having diminished dexterity in the hands. The eating utensil can include a holder and a utensil. The holder can include an elongated body, an opening defined on a distal end of the body, a flange extending from a proximal end of the body, and a first phalange receiver and a second phalange receiver arranged on one or more sides of the body. The utensil can include a shaft and a head, the shaft having a first end and a second end opposite the first end. The head of the utensil can be connected to the second end of the shaft. The opening of the holder can be configured to receive the second end of the shaft of the utensil such that the utensil is removably attachable to the holder. The holder can be configured to be received within the user's hand such that at least a first phalange of the user's hand is received and constrained to a first side of the body by the first phalange receiver, at least a second phalange of the user's hand is received and constrained to a second side of the body opposite the first side by the second phalange receiver, and the flange contacts a portion of the user's hand between the first and the second phalanges.

In some embodiments, the first phalange receiver can include at least one strap and at least one strap retainer. In other embodiments, the first phalange receiver can include a first strap and a first strap retainer, and the second phalange receiver can include a second strap and a second strap retainer.

In further aspects, the present disclosure provides a holder for an eating utensil that is configured to assist persons having diminished dexterity in the hands, the eating utensil including the holder and a utensil. The holder can include an elongated body, an opening defined on a distal end of the body, a flange extending from a proximal end of the body, and at least two phalange receivers arranged on the body between the proximal and the distal ends. The opening of the body can be configured to receive a shaft of the utensil such that the utensil is removably attachable to the holder. The holder can be configured to be received within the user's hand such that at least a first phalange of the user's hand is received and constrained to a first side of the body by at least a first phalange receiver, at least a second phalange of the user's hand is received and constrained to a second side of the body opposite the first side by at least a second phalange receiver, and the flange contacts a portion of the user's hand between the first and the second phalanges. In some embodiments, the first phalange receiver can include a strap and a strap retainer.

To the accomplishment of the foregoing and related ends, the disclosure, then, comprises the features hereinafter fully described. The following description and the annexed drawings set forth in detail certain illustrative aspects of the disclosure. However, these aspects are indicative of but a few of the various ways in which the principles of the disclosure can be employed. Other aspects, advantages and novel features of the disclosure will become apparent from the following detailed description of the disclosure when considered in conjunction with the drawings.

Figure 1:
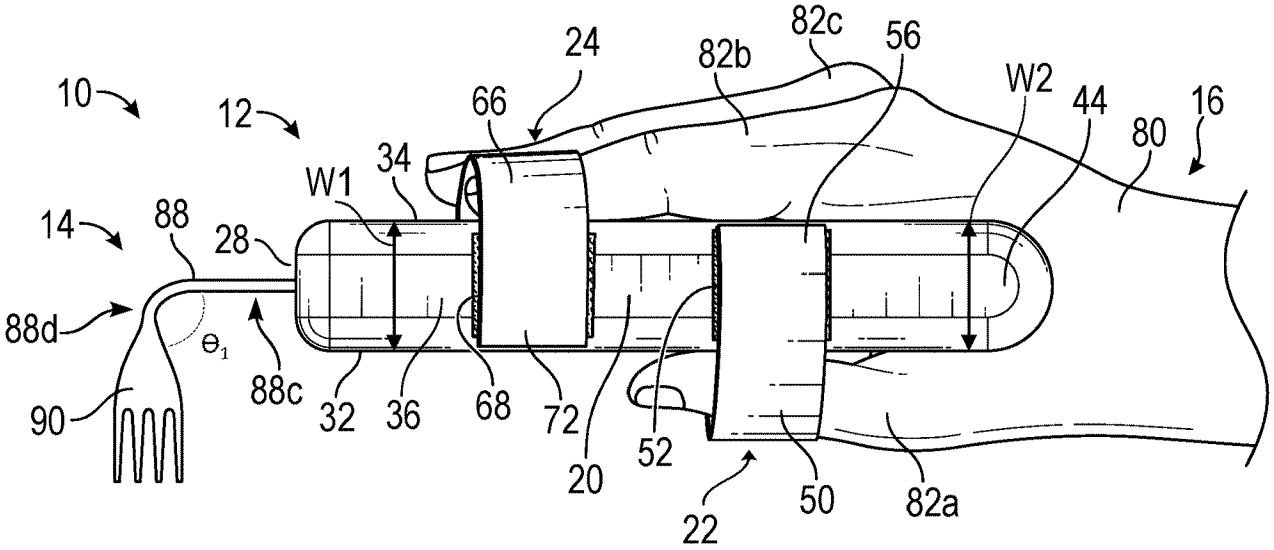
FIG. 1 is a top plan view of an exemplary eating utensil secured within a user's hand that is consistent with at least some aspects of the present disclosure.

While the disclosure is susceptible to various modifications and alternative forms, specific embodiments thereof have been shown by way of example in the drawings and are herein described in detail. It should be understood, however, that the description herein of specific embodiments is not intended to limit the disclosure to the particular forms disclosed, but on the contrary, the intention is to cover all modifications, equivalents, and alternatives falling within the spirit and scope of the disclosure as defined by the appended claims.

DETAILED DESCRIPTION OF THE DISCLOSURE

The various aspects of the subject disclosure are now described with reference to the annexed drawings, wherein like reference numerals correspond to similar elements throughout the several views. It should be understood, however, that the drawings and detailed description hereafter relating thereto are not intended to limit the claimed subject matter to the particular form disclosed. Rather, the intention is to cover all modifications, equivalents, and alternatives falling within the spirit and scope of the claimed subject matter.

The term "conventional eating utensils," as used herein, refers to forks, knives, and spoons, or a combination thereof, known in the art that generally include a utensil head disposed along a shaft, which may have a handle to be grasped by a user's hand.

The term "about," as used herein, refers to variation in the numerical quantity that may occur, for example, through typical measuring and manufacturing procedures used for eating utensils or other articles of manufacture that may include embodiments of the disclosure herein; through inadvertent error in these procedures; through differences in the manufacture, source, or purity of the ingredients used to make the compositions or mixtures or carry out the methods; and the like. Throughout the disclosure, the terms "about" and "approximately" refer to a range of values ±5% of the numeric value that the term precedes.

Figure 2:
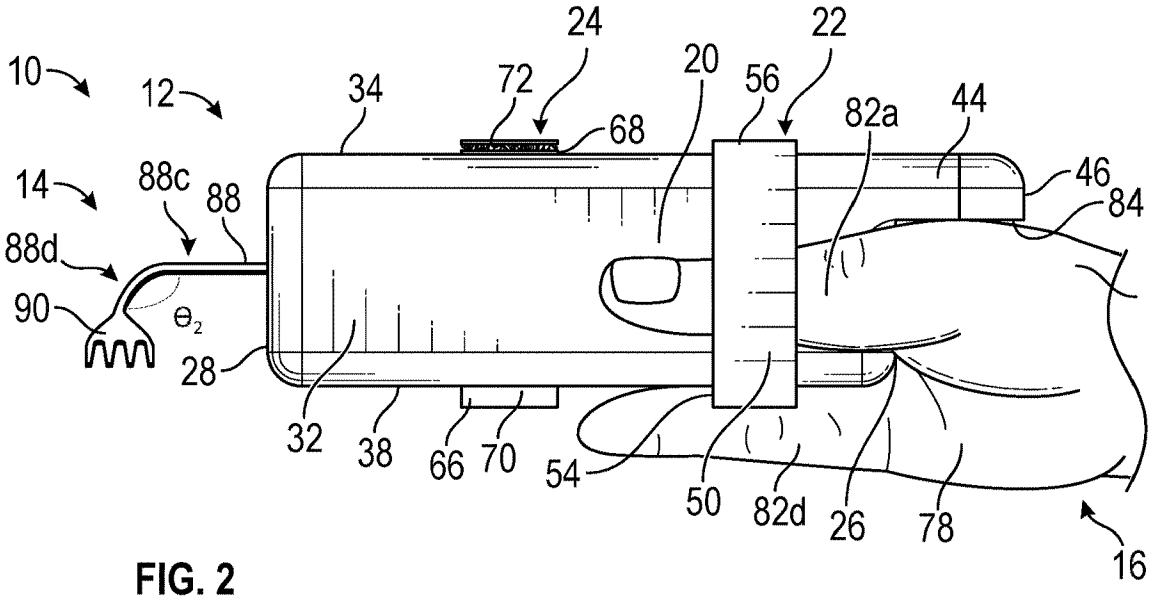
FIG. 2 is a right side view of the eating utensil secured within the user's hand shown in FIG. 1.

Referring now to the drawings wherein like reference numerals correspond to similar elements throughout the several views and, more specifically, referring to FIGS. 1-4, the present disclosure will be described in the context of an exemplary eating utensil 10 including, among other components, a holder 12 and a utensil 14. Referring specifically to FIGS. 1 and 2, the holder 12 of the eating utensil 10 is configured to be received within a hand 16 of a user. For ease of disclosure, the eating utensil 10 being configured for attachment to a right hand 16 of a user will be referenced to describe aspects of the disclosure. The disclosure below with reference to the eating utensil 10 is applicable also to an exemplary eating utensil 10 configured for attachment to a left hand (not shown) of a user. In such embodiments, the eating utensil 10, including some components, as described with reference to FIGS. 1-4 can be mirrored about a longitudinal axis of the eating utensil to accommodate the left hand of the user. In some embodiments of the disclosure, the eating utensil 10 can be configured to accommodate both a right hand 16 and a left hand of a user.

The holder 12 includes an elongate body 20, a first or medial phalange retainer 22, and a second or lateral phalange retainer 24. The elongate body 20 of the holder 12 has a first or proximal end 26 and a second or distal end 28 that together define a first or medial side 32, a second or lateral side 34 opposite the medial side 32, a third or top side 36, and a fourth or bottom side 38 of the body 20. A longitudinal axis 40 (see FIG. 3) of the body 20 extends through the proximal and the distal ends 26, 28, and the body 20 is generally symmetrical about the longitudinal axis 40. The body 20 has a width W1 measured from the medial side 32 to the proximal side 34, e.g., proximate the distal end 28. The width W1 of the body 20 corresponds to a width capable of comfortably spanning the distance between two or more phalanges of a user's hand, and thus, should be an adequate width to provide support between them. In some embodiments, the body 20 has a width W1 in a range of about 10 mm to about 80 mm, in a range of about 20 mm to about 60 mm, or in a range of about 25 mm to about 45 mm.

Figure 3:
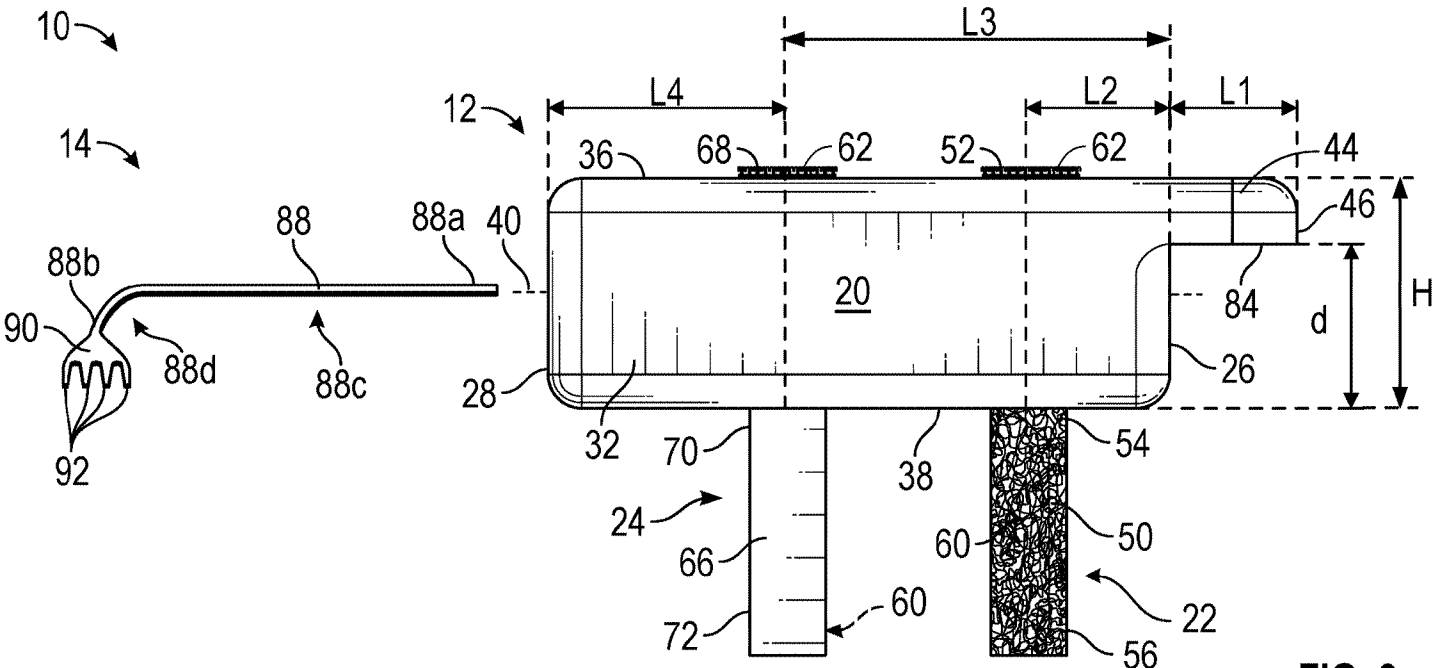
FIG. 3 is a right side exploded view of the eating utensil shown in FIG. 1.

A flange 44 extends from the proximal end 26 adjacent to the top side 36 of the body 20 such that, in the illustrated embodiment, the flange 44 forms a continuous surface with the top side 36 of the body 20. As best seen in FIG. 3, a proximal end 46 of the flange 44 extends from the proximal end 26 of the body 20 parallel to the longitudinal axis 40 to a first length L1 from the proximal end 26. In the illustrated embodiment, the flange 44 has a width W2 measured from a medial side to a lateral side of the flange 44 (i.e., in this embodiment, the medial side 32 and the lateral side 34 of the body 20) that is the same as the width W1 of the body 20. In some embodiments, the flange 44 has a width W2 that is less than or greater than a width W1 of the body 20. In particular, and as discussed in greater detail below, in some embodiments, a flange having a larger width than the body of the holder may provide additional support in along the user's hand. In some embodiments, a ratio between a width W1 of the body 20 and a width W2 of the flange is about 10:11, is about 2:3, or is about 1:2.

Figure 4:
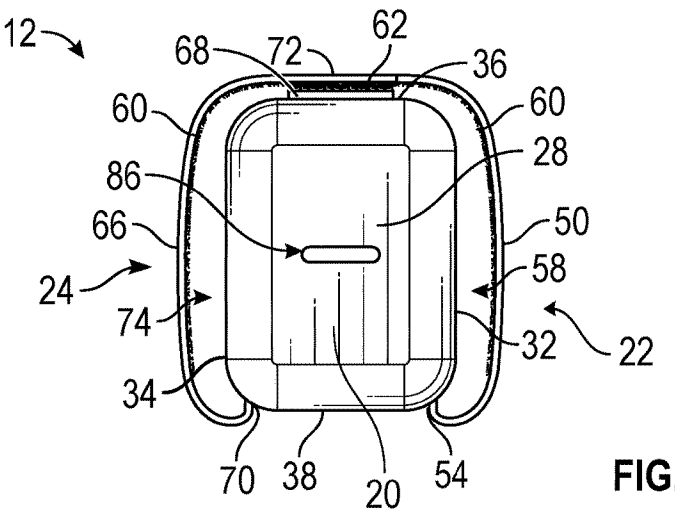
FIG. 4 is a front or distal end plan view of a holder of the eating utensil shown in FIG. 1.

Referring now to FIGS. 3 and 4, the medial phalange retainer 22 includes a medial strap 50 extending from the bottom side 38 of the body 20 and a medial strap retainer 52 disposed on the top side 36 of the body 20. A first end 54 of the medial strap 50 is disposed along the bottom side 38 adjacent to the medial side 32 of the body 20 at a second length L2 from the proximal end 26 of the body 20 measured parallel to the longitudinal axis 40. The medial strap 50 is configured to extend from the bottom side 38 to the top side 36 along the medial side 32 of the body 20 such that a second end 56 of the medial strap 50 can contact the medial strap retainer 52 disposed on the top side 36. As such, the medial strap retainer 52 is arranged along the top side 36 of the body 20 at the same length, the second length L2, from the proximal end 26 of the body 20 as the medial strap 50. As discussed in greater detail below, the second length L2 can correspond to the amount of lateral support provided by the holder. Thus, in some embodiments, the medial strap retainer 52 is arranged at the second length L2 from the proximal end 26 of the body in a range of about 10 mm to about 100 mm, in a range of about 20 mm to about 85 mm, or in a range of about 30 mm to about 60 mm.

With continued reference to FIGS. 3 and 4, the medial strap retainer 52 is configured to receive and secure portions of the second end 56 of the medial strap 50 such that the medial strap 50 forms a medial opening or aperture 58 of the medial phalange retainer 22 when the second end 56 of the medial strap 50 is secured to the medial strap retainer 52. In the illustrated embodiment, the medial strap 50 is securable to the medial strap retainer 52 via a plurality of loops 60 disposed on an inner side of the medial strap 50 that are configured to mate with a plurality of hooks 62 included on the medial strap retainer 52 (i.e., a Velcro-type fastening assembly). In other embodiments, and as discussed in greater detail below, other various fastening means may be implemented to secure the second end 56 of the medial strap 50 to the medial strap retainer 52.

Referring still to FIGS. 3 and 4, the lateral phalange retainer 24 is similar to the medial phalange retainer 22 but positioned at a third length L3 from the proximal end 26 of the body 20. In the illustrated embodiment, the third length L3 is greater than the second length L2 such that the lateral phalange retainer 24 is disposed closer to the distal end 28 of the body 20 than the medial phalange retainer 22. In some embodiments, the lateral phalange retainer 24 is disposed closer to the distal end 28 of the body 20 than the medial phalange retainer 22. In some embodiments, the medial and lateral phalange retainers 22, 24 are disposed at the same length from the proximal end 26 of the body 20.

Similar to the medial phalange retainer 22, the lateral phalange retainer 24 includes a lateral strap 66 extending from the bottom side 38 of the body 20 and a lateral strap retainer 68 disposed on the top side 36 of the body 20. A first end 70 of the lateral strap 66 is disposed along the bottom side 38 adjacent to the lateral side 34 of the body 20 at the third length L3 from the proximal end 26 of the body 20. The lateral strap 66 is configured to extend from the bottom side 38 to the top side 36 along the lateral side 34 of the body 20 such that a second end 72 of the lateral strap 66 can contact the lateral strap retainer 68 disposed on the top side 36. As such, the lateral strap retainer 68 is arranged along the top side 36 of the body 20 at the same length, the third length L3, from the proximal end 26 of the body 20 as the lateral strap 66.

With continued reference to FIGS. 3 and 4, the lateral strap retainer 68 is configured to receive and secure portions of the second end 72 of the lateral strap 66 such that the lateral strap 66 forms a lateral opening or aperture 74 of the lateral phalange retainer 24 when the second end 72 of the lateral strap 66 is secured to the lateral strap retainer 68. In the illustrated embodiment, the lateral strap 66 is securable to the lateral strap retainer 68 via the plurality of loops 60 disposed on an inner side of the lateral strap 66 that are configured to mate with the plurality of hooks 62 included on the lateral strap retainer 68, similar to the medial phalange retainer 22. Although the loops 60 are only shown in the FIG. 3 with respect to the medial strap 50, it will be appreciated that similar loops can be applied to the lateral strap 66. Additionally, although the loop elements have been described herein as being components of the straps and hook elements have been described as being components of the retainers, it will be appreciated that one or both of the straps can have hook elements applied thereto, with loop elements applied to the corresponding retainer(s).

In some embodiments, other fastening or retaining means known in the art may be utilized in the straps 50, 66 and the strap retainers 52, 68 to secure the medial and the lateral straps 50, 66 to the medial and lateral strap retainers 52, 68. For example, in some embodiments, the medial and the lateral strap retainers 52, 68 may include a single hook or post and the medial and the lateral straps 50, 66 may include a plurality of openings disposed at various lengths from the second ends 56, 72 that are configured to receive the hook or post of the medial and the lateral strap retainers 52, 68. In some embodiments, the lateral strap 66 and the lateral strap retainer 68 may include fastening means that are different than fastening means included on the medial strap 50 and the medial strap retainer 52. In some embodiments, the medial and the lateral strap retainers 52, 68 may be disposed on the bottom side 38 of the body 20, and the first ends 54, 70 of the medial and the lateral straps 50, 66 may be disposed on the top side 36 of the body 20. In some embodiments, the first end 70 of the lateral strap 66 and the medial strap retainer 52 may both be disposed on the top side 36 of the body 20, and the first end 54 of the medial strap 50 and the lateral strap retainer 68 may be disposed on the bottom side 38 of the body 20, or vice versa.

Further, in some embodiments, one or both of the medial and the lateral phalange retainers 22, 24 may not include the medial and lateral strap retainers 52, 68 that corresponds to the medial and the lateral strap 50, 66. For example, in some embodiments, the lateral phalange retainer 24 may include only the lateral strap 66 while the medial phalange retainer 22 may include both the medial strap 50 and the medial strap retainer 52, or vice versa. In such embodiments, for example, both the first and the second ends 70, 72 of the lateral strap 66 may be connected to the top and bottom sides 36, 38 of the body 20.

Referring specifically to FIG. 4, and as discussed above, the medial and the lateral phalange receivers 22, 24 form or define the medial and the lateral apertures 58, 74 when the medial and lateral straps 50, 66 are secured to the medial and lateral strap retainers 52, 68, respectively. As such, the medial and the lateral phalange receivers 22, 24 are configured such that the medial and the lateral apertures 58, 74 are adjustable to accommodate varying sizes of hands 12 of various users of the eating utensil 10. In the illustrated embodiment, the size of the medial aperture 58, i.e., the length of the medial strap 50 that extends from the first end 54 to the portion of the second end 56 secured to the medial strap retainer 52, may be reduced by securing a different portion of the medial strap 50 that is closer to the first end 54 to the medial strap retainer 52. The medial and lateral straps 50, 66 may be comprised of a non-elastic material that is configured to provide increased support to the user's hand. In other embodiments, the medial and lateral straps 50, 66 may be comprised of a material having at least partial elastic properties, such as rubber or neoprene. In other embodiments, the medial and lateral straps 50, 66 may be comprise of an elastic material such that the medial and lateral straps 50, 66 provide additional fine-tuning adjustability in addition to the lengths of the straps 50, 66.

In some embodiments, the medial and the lateral straps 50, 66 may be configured such that they can extend along both the medial and lateral sides 32, 34 of the body 20. For example, in some embodiments, the first ends 54, 70 of the medial and the lateral straps 50, 66 may be aligned along the longitudinal axis 40 of the body 20 such that, for example, the lateral strap 66 can extend from the bottom side 38 to the top side 36 along either the lateral side 34 or the medial side 32 of the body 20. In such embodiments, the corresponding medial or lateral aperture 58, 74 formed by the lateral strap 66 can be the same size regardless of whether the lateral strap 66 extends along the medial side 32 or the lateral side 34. Further, in such embodiments, both the inner and outer surfaces of at least the lateral strap 66 can include the loops 60.

Similarly, in some embodiments, the medial and/or the lateral straps 50, 66 may be configured to form a plurality of lateral or medial apertures 58, 74. For example, in such embodiments the medial and lateral straps 50, 66 may be configured to extend around both the medial and lateral sides 32, 34 of the body 20 before the second ends 56, 72 of the straps 50, 66 are attached to the strap retainers 52, 68. Thus, in such embodiments, each of the medial and the lateral straps 50, 66 may form both a lateral aperture 74 and a medial aperture 58. Similarly, in some embodiments, one or more of the phalange retainers 22, 24 may further include a strap receiver (not shown) arranged along the medial and lateral sides 32, 34 of the body, which can be configured to receive the first ends 54, 70 of the straps 50, 66 such that a middle portion of the straps 50, 66 are retained within the strap receivers. In such embodiments, each of the straps 50, 66 can form a lower aperture and an upper aperture of each of the medial and the lateral apertures 58, 74 on the medial and lateral sides 32, 34 of the body 20. In other embodiments, the medial and the lateral phalange receivers 22, 24, may be configured to form three or more adjustable apertures 58, 74 on the medial and/or the lateral sides 32, 34 of the body 20.

Further, in some embodiments, the medial and the lateral phalange receivers 22, 24 can each include a plurality of straps that are configured to be secured to a single strap retainer. In other embodiments, the medial and the lateral phalange receivers 22, 24 can each include a plurality of straps and a plurality of strap retainers disposed at various lengths from the proximal end 26 of the body 20. In some embodiments, the medial and lateral straps 50, 66 may be configured to be secured to the medial and the lateral strap retainers 52, 68, respectively, such that straps 50, 66 extend at one or more angles relative to the longitudinal axis 40 along the medial and lateral sides 32, 34 of the body 20.

Still further, in some embodiments, the medial and the lateral straps 50, 66 may be disposed at distances from the proximal end 26 of the body 20 that differ from distances corresponding to the medial and lateral strap retainers 52, 68. For example, in such embodiments, the lateral strap 66 can be disposed along the body 20 at the second distance L2 from the proximal end 26 while the lateral strap retainer 68 can be disposed along the body 20 at the third distance L3 such that the lateral strap 66 extends at an angle along the lateral side 34 of the body 20.

Referring again to FIGS. 1 and 2, and as discussed above, the holder 12 is configured to be secured within a user's hand 16 having an inner surface or palm 78 and an outer surface or dorsal side 80 opposite the palm 78. More specifically, the holder 12 is configured to be held within the hand 12 such that one or more phalanges 82 of the user's hand 16 contacts the first side 32 and the second side 34 of the body 20 of the holder 12 while the proximal end 26 contacts or is adjacent to the palm 78. Further, the flange 44 of the body 20 of the holder 12 is configured to contact, or rest on, at least a portion of the dorsal side 80 of the user's hand 16. The holder 12 having this particular configuration provides lateral support to the holder 12, via the phalanges 82 in contact with the first and second sides 32, 34 of the body 20, as well as vertical support to the holder 12, via the flange 44 in contact with the dorsal side 80 of the user's hand 16.

In the illustrated embodiment of FIGS. 1 and 2, a first digit or thumb 82*a* of the user's hand 16 is adjacent to, or contacts, the first side 32 of the body 20 while a second digit or index finger 82*b*, a third digit or middle finger 82*c*, a fourth digit or ring finger (not shown), and a fifth digit or little finger 82*d* of the user's hand 16 are adjacent to, or contact, the second side 34 of the body 20. Further, a bottom side 84 of the flange 44 contacts, or rests on, a portion of the dorsal side 80 of the user's hand 16 located between the thumb 82*a* and the index finger 82*b*.

Referring specifically to FIG. 3, the body 20 has a height H extending from the top side 36 to the bottom side 38 of the body 20. The height H of the body 20 is a variable, among others, that corresponds to a surface area of the proximate end 26, the medial side 32, and the lateral side 34 of the body 20 that may contact the hand 16, including the number of phalanges 82 on at least one side of the body 20. In some embodiments, the body 20 has a height H configured such that each of the index finger 82*b*, the middle 82*c*, the ring finger (not shown), and the little finger 82*d* of the hand 16 of the user contacts the lateral side 34 of the body 20. In some embodiments, the body 20 has a height H configured such that at least the index finger 82*b* of the user's hand 16 contacts the lateral side 34 of the body 20. In some embodiments, the body 20 has a height H in a range of about 22 mm to about 122 mm, in a range of about 42 mm to about 102 mm, in a range of about 62 mm to about 82 mm, or in a range of about 57 mm to about 77 mm.

Correspondingly, the flange 44 having the first length L1 extending from the proximal side 26 of the body 20 also has a depth d (see FIG. 3) measured from the bottom side 84 of the flange 44 to the bottom side 38 of the body 20. The first length L1 of the flange 44 is a variable, among others, that corresponds to a surface area of the bottom side 84 of the flange 44 that may contact the dorsal side 80 of the user's hand 16 between the thumb 82*a* and the index finger 82*b*. In some embodiments, the first length L1 of the flange 44 is in a range of about 5 mm to about 60 mm, in a range of about 15 mm to about 50 mm, in a range of about 25 mm to about 40 mm, or in a range of about 20 mm to about 30 mm. Similarly, the depth d of the flange 44 corresponds to an amount of surface area of the body 20 that may contact the palm 78 of the user's hand 16. In some embodiments, the depth d of the flange 44 is in a range of about 20 mm to about 120 mm, in a range of about 40 mm to about 100 mm, in a range of about 60 mm to about 80 mm, or in a range of about 55 mm to about 75 mm.

With continued reference to FIG. 3, a fourth distance L4 from the lateral phalange retainer 24 to the distal end 28 of the body 20 of the holder 12 is measured parallel to the longitudinal axis 40. As such, the fourth distance L4 and the third distance L3 together define an overall length of the of the body 20. A particular benefit of the present holder 12 is the conspicuousness of the eating utensil 10 when held within the user's hand 16, while at the same time providing adequate support to the user's hand and phalanges. Further, the use of the eating utensil 10 can be bothersome if the ends of the user's phalanges 82 extend past the distal end 28 of the body and interfere with the user's eating motion. Therefore, in some embodiments, the body 20 has a fourth distance L4 that is configured such that the distal end 28 of the body 20 extends past the each of the phalanges 82 of the user's hand 16 adjacent to the body 20.

Referring yet again to FIG. 4, the body 20 of the holder 12 further includes an opening 86 defined on the distal side 28 of the body 20. The opening 86 is configured to receive the utensil 14 of the eating utensil 10, which includes a shaft 88 and a head 90. The shaft 88 of the utensil 14 has a first or proximal end 88*a* and a second or distal end 88*b*, and the head 90 is attached to the distal end 88*b* of the shaft 88. The head 90 can take the form of any conventional eating utensils known in the art, such as, for example, a spoon or a "spork". In the illustrated embodiment, the head 90 of the utensil 14 is in the form of a fork having a plurality of prongs 92. The utensil 14 may be comprised of a variety of materials, including metals, metallic alloys, plastics or rubbers. In some embodiments, at least a portion of the utensil 14 is comprised of a material having properties that at least a portion of the utensil 14 is bendable yet ridged enough to withstand forces exerted on the bendable portion during use of the eating utensil 10. In some embodiments, the utensil 14 may be coated with a coating having anti-bacterial properties.

Still referring to FIG. 4, the eating utensil 10 is configured to permit a user to more easily align the head 90 of the utensil 14 with their mouth by, for example, arranging the head 90 of the utensil 14 facing toward the first or medial side 32 of the body 20 of the holder 12. This configuration minimizes rotation of the shoulder and/or wrist of the user that may be required to align the head 90 of the utensil 14 with a mouth of the user, particularly in comparison to a utensil 14 having a head 90 that is aligned with the longitudinal axis 40. As such, the shaft 88 of the utensil 14 has a first or proximal portion 88*c* that includes the proximal end 88*a* of the shaft 88 and a second or distal portion 88*d* that includes the distal end 88*b* and is adjacent the proximal portion 88*a* of the shaft 88. In the illustrated embodiment, the shaft 88 is curved such that the head 90 connected to the distal portion 88*d* of the shaft 88 of the utensil 14 is oriented, or extends, toward the medial side 32 of the holder 12.

As best shown in FIG. 1, the proximal portion 88*c* of the shaft 88 is generally uniform and aligned with the longitudinal axis 40 of the body 20 while the distal portion 88*d* of the shaft 88 is disposed at a first angle θ1 relative to the proximal portion 88*c* in a first plane (not shown) extending along the longitudinal axis 40 between the top and bottom sides 36, 38 of the body 20. In some embodiments, the distal portion 88*d* of the shaft 88 is disposed at the first angle $\theta_1$ relative to the proximal portion 88*c* in a range of about 70 degrees to about 175 degrees, in a range of about 80 degrees to about 160 degrees, in a range of about 90 degrees to about 155 degrees, or in a range of about 90 degrees to about 120 degrees.

Similarly, the utensil 14 can be further configured to be curved upward or downward relative to the top side 36 of the holder 12, such as, for example, for ease of orienting the head 90 of the utensil 14 to pick up various types of foods in front of the user or to prevent food from falling from the head 90 of the utensil 14. In the illustrated embodiment, and as best shown in FIG. 2, the distal portion 88*d* of the shaft 88 is also disposed at a second angle θ2 relative to the proximal portion 88*c* in a second plane extending (not shown) along the longitudinal axis 40 between the first and second sides 32, 34 of the body 20, i.e., a plane that is perpendicular to the first plane discussed above or that is normal to a face of the distal end 28 of the body 20. In some embodiments, the distal portion 88*d* of the shaft 88 is disposed at the second angle θ2 relative to the proximal portion 88*c* in a range of about 60 degrees to about 120 degrees, in a range of about 70 degrees to about 110 degrees, in a range of about 75 degrees to about 105 degrees, or in a range of about 80 degrees to about 100 degrees.

In some embodiments, the holder 12 is configured such that the proximal portion 88*c* of the shaft 88 of the utensil 14 is fixedly received within the opening 86. In such embodiments, the holder 12 can be further configured such the proximal portion 88*c* of the shaft 88 of the utensil 14 is slidably moveable within the opening 86 such that the head 90 of the utensil can be adjusted to a plurality of distances from the distal end 28 of the body 20.

However, in some applications, a removably attachable utensil 14 may be particularly beneficial to a user, such as, for example, to clean the utensil 14 after use and/or to switch between utensils 14 having different types of heads 90 during use. As such, in other embodiments, the holder 12 is configured such that the utensil 14 is removably received within the opening 86 such that a user can replace the utensil 14 with another utensil having a similar proximal portion 88*c* (that can be received within the opening 86) but having a distal portion or head with one or more different characteristics to the distal portion 88*d* or head 90 described above. In such embodiments, the holder 12 can further include a lock (not shown) that is configured to removably fix the proximal portion 88*c* of the shaft 88 of the utensil 14 within the opening 86 and may include a button or other user activated means to unlock or remove the utensil 14 from the opening 86. In some embodiments, the proximal portion 88*c* can include a plurality of locking receivers that are configured to be received by the locking means such that the utensil 14 can be removably locked within the opening 86 at various distances from the distal end 28 of the body 20.

Figure 5:
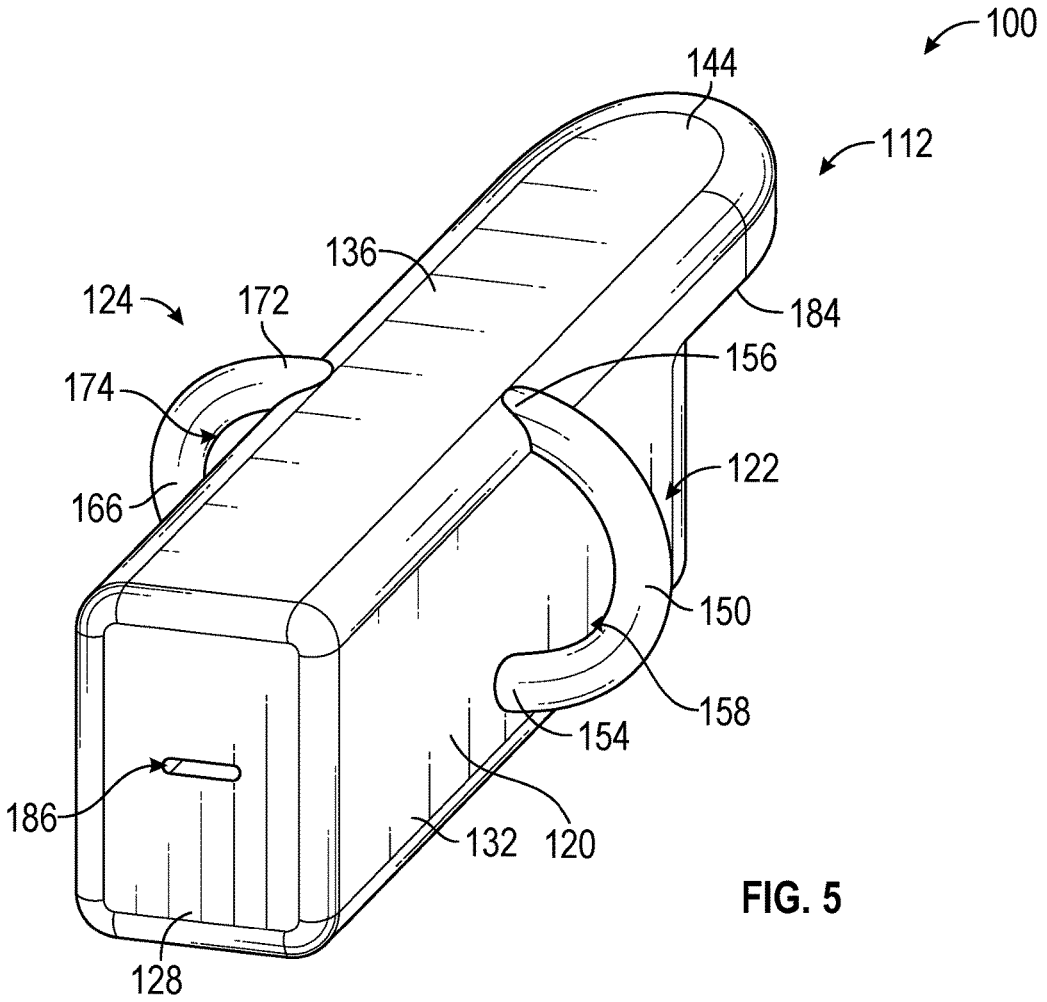
FIG. 5 is a front or distal end, top, and right side perspective view of another exemplary holder of the eating utensil shown in FIG. 1.
Figure 6:
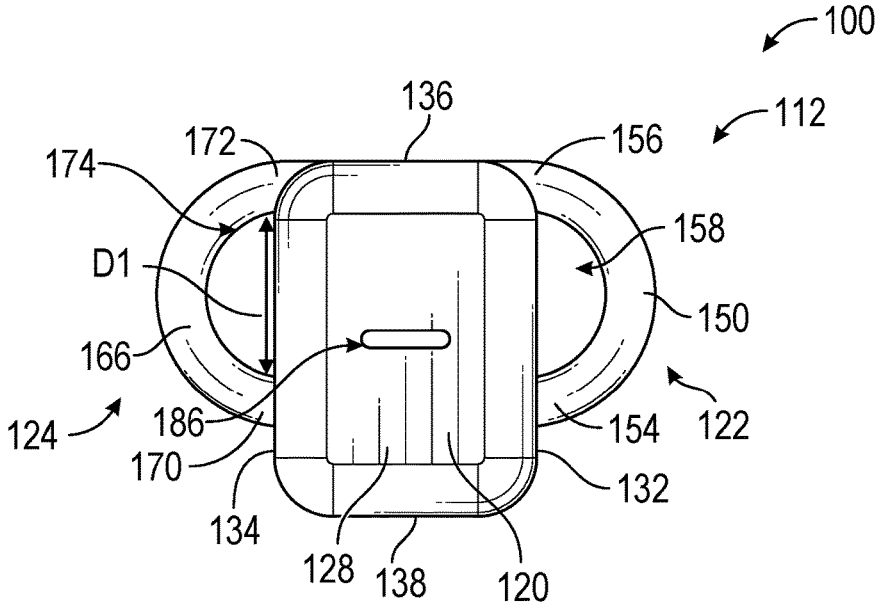
FIG. 6 is a front or distal end plan view of the holder shown in FIG. 5.

In some implementations of the present disclosure, it may be beneficial to reduce or eliminate components of the holder of the eating utensil, for example, for ease of maintenance and/or increased durability of the eating utensil. Referring now to FIGS. 5 and 6, another exemplary embodiment of an eating utensil 100 is depicted, which includes a holder 112. The eating utensil is similar to previous embodiments discussed with reference to FIGS. 1-4, with like elements being indicated by similar reference numerals under the "1xx" series of reference numerals. While the eating utensil 100 is similar to previous embodiments in many aspects, there are some aspects that differ. In particular, the holder 112 of the eating utensil 100 includes a first or medial phalange receiver 122 and a second or lateral phalange receiver 124, which are integrally formed with a body 120 of the holder 112.

Referring specifically to FIG. 6, the medial phalange receiver 122 includes a receiver body 150 formed on the medial side 132 of the body 120. The receiver body 150 extends from a first or lower end 154 disposed proximate to the bottom side 138 of the body 120 to a second or upper end 156 disposed proximate to the upper side 136 of the body 120. A first or medial aperture 158 is defined by the receiver body 150 such that, in the illustrated embodiment, the medial aperture 158 has a semi-circular shape with a partial diameter that is adjacent to the medial side 132 of the body 120.

Likewise, the lateral phalange receiver 124 includes a receiver body 166 formed on the lateral side 134 of the body 120. The receiver body 150 extends from a first or lower end 170 disposed proximate to the bottom side 138 of the body 120 to a second or upper end 172 disposed proximate to the upper side 136 of the body 120. A second or lateral aperture 174 is defined by the receiver body 166 such that, in the illustrated embodiment, the lateral aperture 174 has a semi-circular shape that is adjacent to the lateral side 134 of the body 120, similar to the medial aperture 158 of the medial phalange receiver 122.

In the illustrated embodiment of FIGS. 5 and 6, the medial and the lateral phalange receivers 122, 124 are disposed about the body 120 at the same distance from the proximal end 126 of the body 120. Thus, the holder 112 is configured to accommodate both a right hand and a left hand of a user. This configuration is particularly advantageous if a user desires to use two eating utensil devices 100 with one on each hand, or if a holder 112 of the eating utensil 100 is shared between two or more users having differing dominant hands. In other embodiments, the medial phalange receiver 122 may be disposed about the body 120 at a distance that is less than a distance of the lateral phalange receiver 124. In some embodiments, the medial phalange receiver 122 may include the receiver body 150 that defines the medial aperture 158 and the lateral phalange receiver 134 may include a lateral strap and a lateral strap receiver, for example, similar to the lateral strap 66 and the lateral strap retainer 68 as described with reference to FIGS. 1-4.

With continued reference to FIGS. 5 and 6, in some embodiments, at least a portion of at least one of the medial and the lateral phalange retainers 122, 124 may be comprised of an elastic material, such as, for example, rubber or neoprene. In such embodiments, at least one of the medial and the lateral apertures 158, 174 are configured to elastically deform such that the apertures 158, 174 are expandable from a first diameter D1 to a second diameter (not shown) that is greater than the first diameter D1 when at least one phalange 82 of the user is received within the phalange retainers 122, 124. Once the at least one phalange 82 of the user is removed from the hole, the at least one of the phalange retainers are configured to retract back to the first diameter D1.

In some embodiments, the first and second ends 154, 156, 170, 172 of the phalange retainers 122, 124 can extend from the top side 136 and/or the bottom side 138 of the body 120 of the holder 12. In some embodiments, at least one of the medial or lateral phalange retainers 122, 124 may define two or more medial or lateral apertures that are each configured to receive at least phalange 82 of the hand 16 of the user.

Referring still to FIGS. 5 and 6, in some embodiments, the holder 112, including the phalange retainers 122, 124, may be comprised of a single material. In some embodiments, at least one of the phalange retainers 122, 124 may be comprised of a first material and the rest of the holder 112 can be comprised of a second material that has different properties than the first material. In some embodiments, the holder 112 can be formed of a first material having a first hardness and a protective coating can be applied over the surfaces of the holder 112 that has a second hardness that is less than the first hardness.

Referring to FIGS. 1-6, the eating utensil, including the holder and/or the utensil may be formed through additive manufacturing techniques, such as by 3D printing. To that end, a number of 3D printed techniques may be implemented to form the eating utensil, such as vat photopolymerization, material jetting, binder jetting, powder bed fusion, material extrusion, directed energy deposition, and/or sheet lamination. For example, with reference to FIGS. 5 and 6, in some embodiments, the holder 112, including the phalange retainers 122, 124, can be 3D printed as a single piece, unitary body.

The particular embodiments disclosed above are illustrative only, as the disclosure may be modified and practiced in different but equivalent manners apparent to those skilled in the art having the benefit of the teachings herein.

Furthermore, no limitations are intended to the details of construction or design herein shown, other than as described in the claims below. It is therefore evident that the particular embodiments disclosed above may be altered or modified and all such variations are considered within the scope and spirit of the disclosure. Accordingly, the protection sought herein is as set forth in the claims below.

Thus, the disclosure is to cover all modifications, equivalents, and alternatives falling within the spirit and scope of the disclosure as defined by the following appended claims.

To apprise the public of the scope of this disclosure, the following claims are made:

What is claimed is:

1. An eating utensil to assist persons having diminished dexterity in hands or wrists, the eating utensil comprising:

a holder including:

an elongated body having a proximal end that is curved and configured to abut a user's hand between a thumb and an index finger, a distal end opposite the proximal end, and a longitudinal axis extending through the proximal and the distal ends;

a flange extending from the proximal end of the body adjacent to a top side of the body and parallel to the longitudinal axis of the body, the flange configured to abut a dorsal surface of the hand;

a first phalange receiver on a first side of the body between the proximal and distal ends, the first phalange receiver configured to encircle a thumb; and a second phalange receiver arranged on a second side of the body between the proximal and distal ends, the second phalange receiver configured to encircle an index finger;

a shaft having a first end and a second end opposite the first end, the first end of the shaft being fixedly attached to the distal end of the body and the second end of the shaft extending from the distal end of the body such that at least a proximal portion of the shaft including the first end extends parallel to the longitudinal axis of the body; and a utensil head connected to the second end of the shaft.

2. The eating utensil of claim 1, wherein the first phalange receiver is arranged along the body of the holder at a first distance from the proximal end of the body, and the second phalange receiver is arranged along the body of the holder at a second distance from the proximal end of the body, the second distance being greater than the first distance.

3. The eating utensil of claim 2, wherein the first phalange receiver includes a first strap and a first strap retainer, and the second phalange receiver includes a second strap and a second strap retainer, and wherein the first and the second straps have a first end and a second end opposite the first end.

4. The eating utensil of claim 3, wherein the first end of the first strap is arranged along a bottom side of the body at the first distance from the proximal end of the body, and the first strap retainer is arranged along the top side of the body at the first distance from the proximal end of the body, wherein the first end of the second strap is arranged along the bottom side of the body at the second distance from the proximal end of the body, and the second strap retainer is arranged along the top side of the body at the second distance from the proximal end of the body, wherein the first strap retainer is configured to removably retain the second end of the first strap as the first strap extends along the first side of the body, and wherein the second strap retainer is configured to removably retain the second end of the second strap as the second strap extends along the second side of the body.

5. The eating utensil of claim 4, wherein the first ends of the first and the second straps are fixedly attached to the bottom side of the body.

6. The eating utensil of claim 1, wherein the first and the second phalange receivers are configured to be moveably fixable along the first and second sides of the body, respectively, at a plurality of distances from the proximal end of the body.

7. The eating utensil of claim 6, wherein the first and the second phalange receivers include at least one aperture extending parallel to the longitudinal axis of the body.

8. The eating utensil of claim 7, wherein the apertures of the first and second phalange receivers are expandable between a first diameter and a second diameter that is greater than the first diameter.

9. The eating utensil of claim 8, wherein at least a portion of the first and second phalange receivers are comprised of an elastic material, and wherein the first and second phalange receivers are configured to be elastically deformable such that the apertures are expandable from the first diameter to at least the second diameter when at least one phalange of the user's hand is received within the apertures.

10. The eating utensil of claim 1, wherein a distal portion of the shaft includes the second end of the shaft, the distal portion of the shaft being arranged at an angle relative to a proximal portion of the shaft.

11. The eating utensil of claim 10, wherein the angle is a first angle in a range of 90 degrees to 170 degrees measured in a first plane transverse to the longitudinal axis between a first side of the body and a second side of the body opposite the first side.

12. The eating utensil of claim 11, wherein the distal portion of the shaft is further arranged at a second angle relative to the proximal portion of shaft, the second angle being measured in a second plane that is perpendicular to the first plane.

* * * * *